US006482361B1

(12) United States Patent
Suovaniemi

(10) Patent No.: US 6,482,361 B1
(45) Date of Patent: Nov. 19, 2002

(54) SUCTION DEVICE

(75) Inventor: Osmo Suovaniemi, Helsinki (FI)

(73) Assignee: Biohit OYJ, Helsinki (FI)

( * ) Notice: Subject to any disclaimer, the term of this patent is extended or adjusted under 35 U.S.C. 154(b) by 0 days.

(21) Appl. No.: 09/383,633

(22) Filed: Aug. 26, 1999

(30) Foreign Application Priority Data

Aug. 26, 1998 (FI) ..... 981827

(51) Int. Cl.[7] ..... B01L 3/02

(52) U.S. Cl. ..... 422/100; 73/864.13; 73/864.14; 422/101

(58) Field of Search ..... 73/863.32, 864.11, 73/864.13, 864.14, 864.16; 422/100, 101, 99; 436/180

(56) References Cited

U.S. PATENT DOCUMENTS 3,901,413 A * 8/1975 Harris
4,296,071 A 10/1981 Weiss et al. ..... 422/100
4,444,062 A 4/1984 Bennett et al. ..... 73/864.11
4,511,534 A 4/1985 Bennett, Jr. et al. ..... 73/863.32
4,852,620 A 8/1989 Jakubowicz et al. ..... 422/100
4,999,164 A * 3/1991 Puchinger et al. ..... 422/100
5,406,856 A 4/1995 Kühn ..... 73/864.11
6,117,394 A * 9/2000 Smith ..... 422/100

* cited by examiner

*Primary Examiner*—Joseph W. Drodge
(74) *Attorney, Agent, or Firm*—Birch, Stewart, Kolasch & Birch, LLP

(57) ABSTRACT

A suction device for dispensing a liquid having a membrane device mounted in a gastight manner in the air space jointly formed by the cylindrical space of its end part and the sample space of a tip to be mounted onto the end part, the membrane device comprising a membrane, made of a liquid and gas impermeable, flexible, reversibly deformable material, with which membrane the reciprocating device in the cylindrical space can be brought into contact for taking a liquid sample into the sample space of the tip and/or removing it therefrom. Also, a method for dispensing a liquid with a suction device has the reciprocating device in the cylindrical space enclosed within the end part of the suction device brought into contact with a membrane of the membrane device mounted in a gastight manner in the air space jointly formed by the cylindrical space and the sample space of the tip, to be mounted onto the end part, for taking a sample into the sample space and/or removing it therefrom and wherein the membrane device is released from the end part of the suction device by bringing the reciprocating device past its position used for taking a sample and/or removing it.

19 Claims, 3 Drawing Sheets

SUCTION DEVICE

FIELD OF THE INVENTION

The object of this invention is a suction device, such as a mechanical or electronic pipette comprising a body and an associated end part with an open distal end directed away from the body for removably attaching a tip enclosing a sample space for receiving a liquid sample, the end part enclosing a cylinder space containing a reciprocatingly movable means for receiving a sample to the tip and removing it therefrom.

The object of this invention is also a method for dispensing, transferring, diluting, titrating and/or mixing a liquid with a suction device having an end part enclosing a cylindrical space containing a reciprocatingly moving means for sample taking and removal.

DESCRIPTION OF THE RELATED ART

Over approximately the past three decades pipettes have been in use having attached liquid reservoirs, that is pipette tips, from which liquid has escaped to the inner parts of the pipette, for example due to careless operation of the pipette, or in the form of liquid molecules vaporized from the liquid. The contamination of the inner parts of the pipette has jeopardized labour safety and reduced or even completely terminated the reliable operation of the pipette itself. Naturally this cannot be accepted in precise laboratory work.

Due to these problems pipette manufacturers recommend that the pipettes are disassembled and cleaned at regular intervals by the pipette users. In this procedure almost always also the plunger and the gasket of the pipette are re-lubricated and often also the pipette has to be re-calibrated, i.e. the pipetted, dispensed etc. liquid volumes are set to correspond to the volumes set on the scale of the pipette. This disassembling and reassembling of the pipette, in addition to being an inconvenient and laborious procedure, does not guarantee that the pipette would not contain infection agents or other contamination such as DNA- and RNase-contamination which interferes with PCR-work. Therefore some pipette manufacturers have started to manufacture pipettes, which are claimed to be sterilizable in an autoclave. Sterilization in the autoclave docs not, however, remove DNA- and RNase-contamination from the pipette parts. It is a very tedious operation and often the operation itself damages parts of the pipette to such an extent that the pipette will not function sufficiently accurately and reliably any more. When the pipette is used after the sterilization, it is possible that it will be contaminated already with the first pipetting.

U.S. Pat. No. 5,406,856 discloses a suction device which is meant to be used with such disposable tips, which have a tip portion to be inserted into a liquid, the tip portion having an opening for taking a liquid sample and removing it and in which disposable tips that part to be adapted onto the end of the body of the suction device is closed towards the suction device. The form of this closed part and simultaneously its volume can be changed with a means within the end part of the body of the suction device. In this solution the contamination can be prevented, but the disposable tip used is a special tip. In addition it must be noticed, that this special tip is adapted into the ond part of the body of the suction device, whereby the end part must be made greater in its outer dimension than the disposable tip itself.

U.S. Pat. No. 4,444,062 discloses a multichannel suction device having a flexible membrane mounted between the body of the suction device and an attached tipstand so, that rods in the plunger movable within the body of the suction device come into contact with the membrane, when the plunger is pushed down-wards. In this solution the membrane is secured either on the undersurface of the body or on the upper surface of the tipstand or two membranes are used of which the first one is secured on the undersurface of the body and the second one on the upper surface of the tipstand. The tipstand itself is mounted to the body with a screw connection. In an embodiment of this invention, the tipstand assembly consisting of a tipstand with attached tubes and tips attached to these and a membrane secured onto the upper surface of the tipstand can be one disposable moulded plastic unit which is mounted to the body of the suction device with a suitable quick connection method. In the solution according to this patent, nothing is disclosed of the removal of the membrane secured on the undersurface of the tipstand or on the upper surface of the body or on the release of the entire tipstand assembly from the body of the suction device by means of the movement of the plunger.

U.S. Pat. No. 4,296,071 discloses a flexible bellows-like means mounted within the body of the pipette. One end of this bellows-like means is attached fixedly in the body of the pipette and the bellows-like means is not meant to be releasable in accordance with the invention.

BRIEF SUMMARY OF THE INVENTION

The drawbacks mentioned above are avoided with the solution according to the invention. It is characterising to the method according to the invention that the means, such as a plunger, moving reciprocatingly in the cylindrical space enclosed by the end part of the suction device, is brought to move in the direction of the distal end of the end part into contact with a flexible, liquid and gas impermeable membrane of a membrane means, which is mounted in a gas tight manner in the air space formed jointly by the said cylindrical space and the sample space of a tip mounted onto the end part for changing, as a result of deformation of the membrane the volume of the space delimited by the said membrane from the said air space in the direction of that end of the tip, which is to be inserted into the liquid, for taking a sample into the sample space and/or removing it therefrom.

According to a preferred embodiment of the disclosed invention the membrane means in the cylindrical space or mounted in the end part of the suction device can be removed by continuing the movement of the plunger, moving within the cylindrical space, past the positions used in taking and/or removing samples. In another preferred embodiment both the membrane means and the tip can be removed with the movement of the said plunger.

The suction device itself can be as such of a known type operated manually or e.g. electrical, and it can be independently operated or functioning as a part of some apparatus, e.g. a pipette. When in the following description the word 'pipette' is used, it means generally all types of suction devices defined above, which function as pipettes, dispensers, diluters, titraters or mixers or in addition as combinations of all of these or some of them.

It is characterising to the device according to the invention that the suction device contains in its end part a removable membrane means which is mounted in a gas tight manner in the air space jointly defined by the cylindrical space and the sample space of a tip to be attached to the end part and comprising a membrane made of a liquid and gas impermeable, flexible, reversibly deformable material, with which membrane the means movable in the cylindrical space can be brought into contact.

The means, a plunger, reciprocatingly moving in the cylindrical space can thus be brought into contact with the membrane of the said membrane means and the plunger moving further towards the opening in the end part of the suction device brings about a deformation of this membrane, whereby the volume of the space, delimited by the membrane from the said joint air space in the direction of the end of the tip to be inserted in a liquid, changes. When taking samples and/or removing them the movement of the plunger is restricted so that the limit of reversible deformation of the said membrane is not exceeded. During the return movement of the plunger the membrane returns towards its original form and regains it, when the plunger and the membrane disengage. In a preferable embodiment of the suction device, the membrane means is easily attachable and releasable and can advantageously be disposable.

In a preferable embodiment of the invention, the said membrane means is mounted in the cylindrical space in the end part of the suction device preferably to seal against a shoulder in the cylindrical space.

In another preferable embodiment of the suction device according to the invention the said membrane means is mounted in the opening in the distal end of the end part of the suction device, the opening forming a gas passage between the cylindrical space and the sample space of the tip, to seal this opening in a gas tight manner. The plunger, moving reciprocatingly in the cylindrical space, when extending through the opening comes into contact with the said membrane and the plunger moving further into the sample space of the tip brings about a deformation of this membrane, whereby the volume of the sample space of the tip changes, as explained above.

According to the invention the membrane means is preferably mounted in the air space jointly formed by the cylindrical space within the distal end of the end part of the suction device and the sample space of the tip so that the said membrane means extends into the sample space of the tip in a gas-sealing engagement with the inner surface of the sample space of the tip so that the said plunger, when moving within the cylindrical space and preferably extending through the opening in the end part of the suction device, comes into contact with the said membrane of this membrane means and brings about a change in the volume delimited by the membrane from the sample space of the tip for taking a sample and/or removing it therefrom.

In a preferable embodiment of the invention the membrane of the said membrane means is secured to a frame, which is provided with sealingly attachable means for attaching to the opening in the distal end of the end part of the suction device. The membrane frame can be suitably supported against a shoulder formed on the inner surface of the opening and the membrane is preferably mounted to that part of the frame, which extends away from the end part of the suction device. The attachment of the membrane means can also be made with a friction joint to the opening in the distal end of the end part.

The membrane means, especially the mombrane frame, can also ba mounted To the end part e.g. with a snap-fit joint e.g. on the outer surface of the distal end of the end part so, that the membrane covers the opening of the end part. The membrane frame can also be supported by a shoulder formed e.g. in the vicinity of the distal end of the end part, preferably on its outer surface. In a preferable embodiment of the invention, be the frame to be attached to the end part can also provided with means to bring about gas tightness between the said membrane frame and the inner surface of the sample space of the tip to be attached onto the distal end of the end part of the suction device.

According to one embodiment, the membrane means can be a bag-like mean, which is compressible like a bellows, and is mounted in the cylindrical space of the end part of the suction device so that the open mouth of this bag-like means attaches, forming a gas-tight seal, to the distal end of the end part of the suction device. This bellows-like membrane means is preferably made of such air and liquid impermeable, flexible material, that the compressing force exerted by the plunger moving in the cylindrical space to the closed end of the bellows-like membrane means within the cylindrical space compresses the membrane means and that the membrane means expands to its original form, when the compressing force of the plunger is released.

In a preferred embodiment of the invention the movement of the plunger moving in the cylindrical space of the end part of the suction device can be continued past the positions used for taking a sample or removing it, whereby the plunger or a telescopic extension thereof can be brought into contact with the membrane means, preferably with the membrane frame, or with pegs, shoulders, or other similar means belonging to the membrane means for releasing the membrane means from the end part of the suction device.

According to the invention the plunger moving within the cylindrical space of the end part of the suction device can move out of the end part through the opening in the distal end of the end part. The said plunger can also be provided with means such as shoulders, projections, pegs, fins, or other corresponding means, which can be brought into contact with the membrane means, preferably with the membrane frame, for releasing the membrane means from the end part of the suction device, when the plunger moves to the membrane means releasing position. The plunger can also be provided with a telescopic extension which can be brought into contact with the membrane means, preferably with the membrane frame, for releasing the membrane means from the end part of the suction device.

In a preferred embodiment of the invention, the membrane means can also comprise means, which, when releasing the membrane means with the movement of the plunger, can be brought into contact with the inner surface of the sample space of the tip removably mounted on the distal end of the end part of the suction device, or with means protruding from the inner surface into the sample space to bring about the removal of the tip from the end part of the suction device together with the removal of the membrane means.

According to an preferred embodiment of the invention, the membrane means can be removed from the end part of the suction device with tip removal means in the suction device e.g. when the membrane means is attached onto the end part of the suction device. In another preferred embodiment of the invention, the tip can be removed together with the membrane means with the removal means in the suction device.

The suction device according to the invention is also suitable for laboratory work based on the PCR-techniques, because the membrane means according to the invention prevents the DNA- and RNase-contamination of the inner parts of the pipette and thus the cross-contamination of different samples and reaction mixtures.

According to an alternative embodiment, used in an electronic pipette, the pipette is provided with identification means for identifying the membrane means alternative used and for communicating this information to a microprocessor of the pipette for bringing about a corresponding correction in the volumes dispensed by the pipette.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described with working examples with reference to the appended drawings, which are given by way of illustration only, and thus are not limitative of the present invention, and wherein.

DETAILED DESCRIPTION OF THE INVENTION

Figure 1:
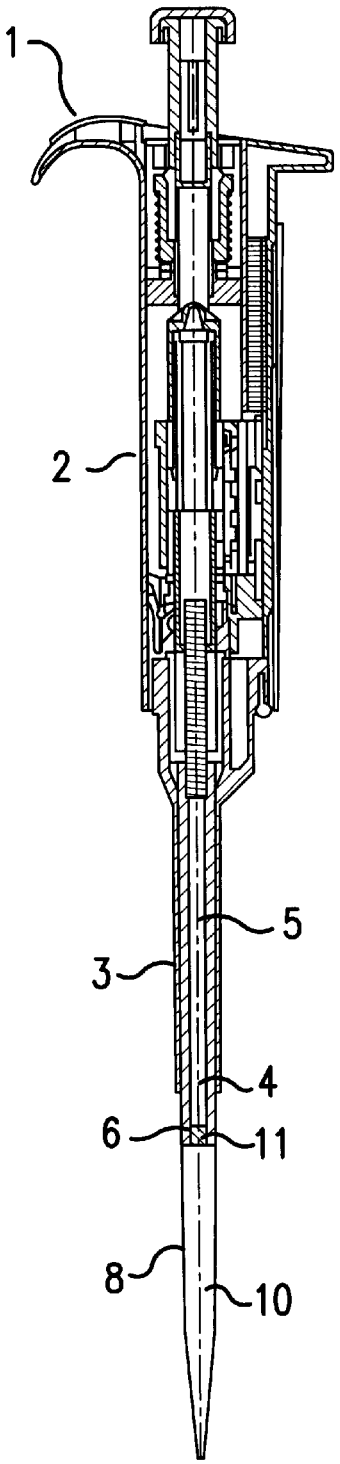
FIG. 1 discloses a lengthwise cross-section of a pipette functioning as a suction device with a replaceable tip being attached, FIG. 2 discloses the end part of the pipette according to FIG. 1 and the attached tip magnified, and FIGS. 3 and 4 disclose an alternative embodiment of the membrane means according to FIG. 2.

In FIGS. 1–5 like reference numbers are being used for like parts. In FIG. 1 of the drawing, the suction device or pipette is referred as an entity with reference number 1, and it consists of a body 2 and an associated end part 3, onto which a tip 8 has been mounted. In the cylindrically shaped air space 4 of the end part 3, in its lengthwise direction, a plunger means 5 is moving slidably. The distal end 6 of the end part 3 includes an opening 7, through which the plunger means 5 can extend into the sample space 9 of the tip 8 in the example of FIGS. 2–4. In the embodiments disclosed in the figures, there is a liquid sample 10 in the sample space 9 of the tip 8

Figure 2:
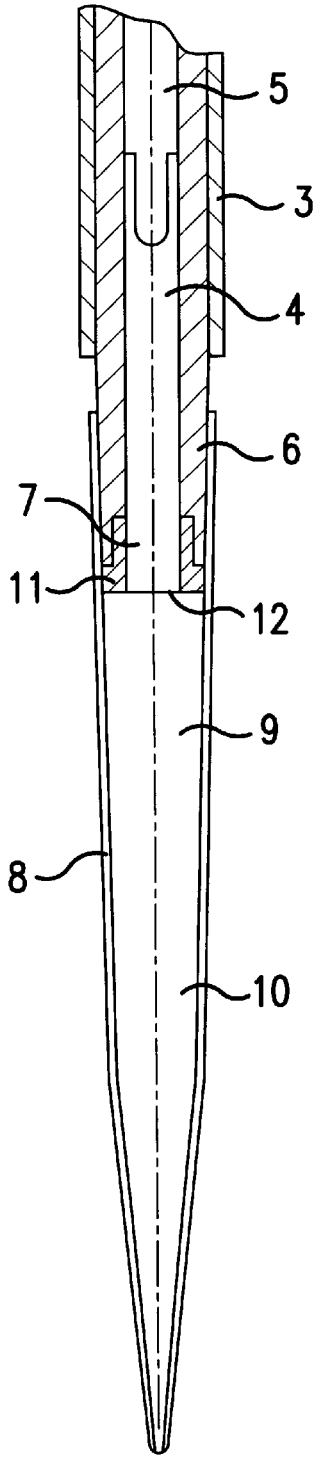

In FIGS. 1 and 2 a membrane means, according to the invention, is shown attached in the opening 7 of the end part 3 of the body 2 of the suction device 1. In the embodiment shown the membrane means 11 is substantially a cylindrically shaped plug-like means, which has been sealingly mounted into the opening 7 of the end part 3 and where it stays in place with the help of a friction force. The membrane means 11 extends a distance into the sample space 9 of the tip 8, however, distinctly above the surface of the liquid sample 10.

Figure 3:
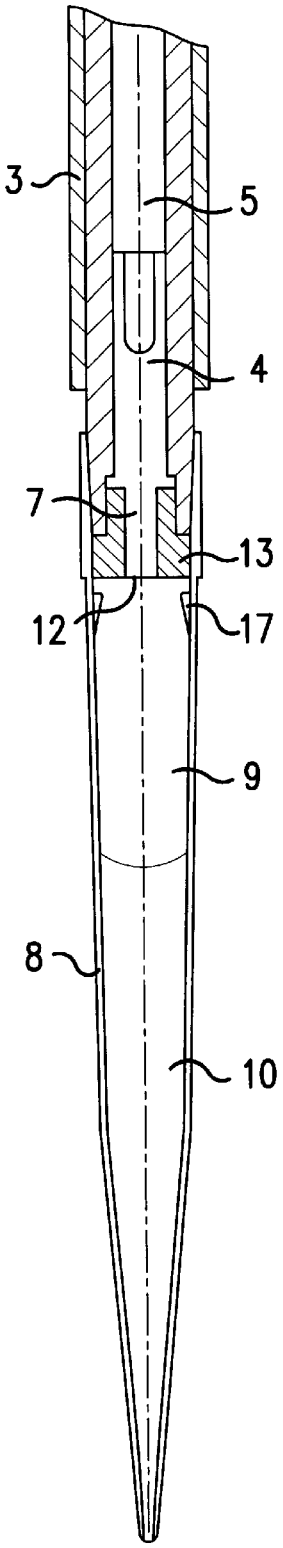

In FIG. 3 an alternative embodiment of the invention is shown, in which the membrane means comprises a frame 13 and a membrane 12 mounted thereon, whereby the frame 13 has been adapted to seal against the inner surface of the sample space 9 of the tip 8.

Figure 4:
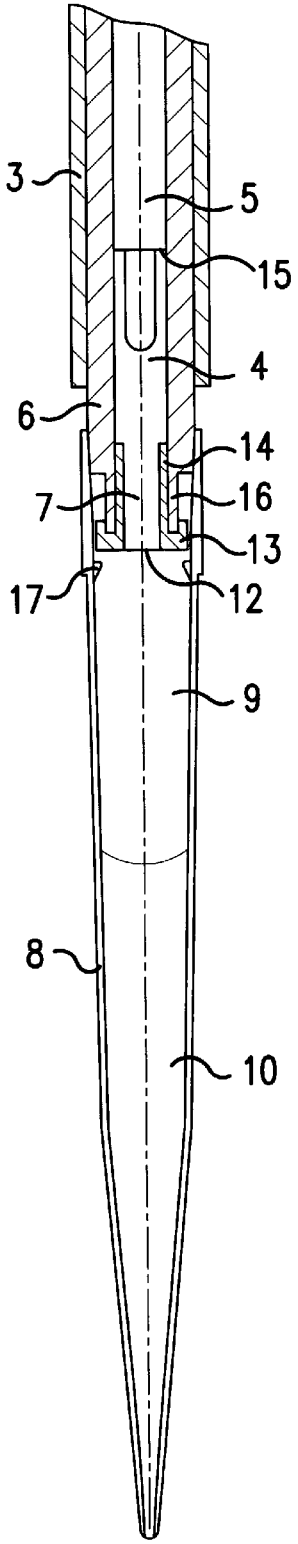

In FIG. 4 an alternative embodiment of the invention is shown, in which the membrane 12 in an appropriate way, e.g. supported by the frame 13, is mounted onto the distal end 6 of the end part 3 so, that the membrane 12 covers the opening 7 of the end part 3. In the disclosed embodiment, the end part 3 has on its outer surface in the vicinity of the distal end 6 projections 16, which cooperate with a groove or similar in the frame 13 for attaching the membrane means to the end part of the suction device. The frame 13 can also be mounted onto the distal end 6 of the end part 3 using a suitable snap-lit joint.

Figure 5:
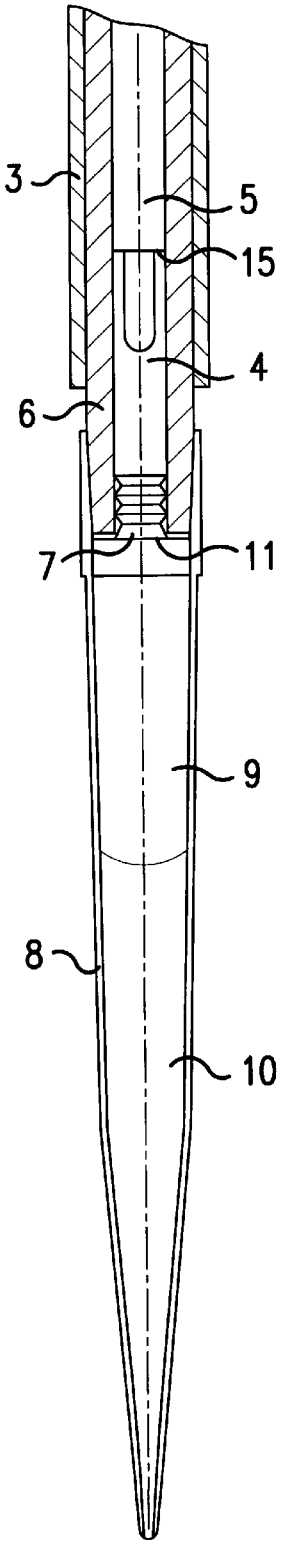
FIG. 5 discloses an alternative embodiment of the membrane means.

In FIG. 5 an embodiment of the invention is shown, in which the membrane means 11 is a bellows-like, reversibly compressible means, which is mounted in the opening 7 in the distal end 6 of the end part 3 so, that the open mouth part of the bellows-like membrane means 11 attaches sealingly to the distal end 6 and the closed part of the membrane means 11 is within the cylindrical space 4. The plunger 5 moving in the cylindrical space 4 can be brought into contact with the part of the membrane means 11 within the cylindrical space 4, whereby the movement of the plunger 5 towards the opening 7 in the distal end 6 of the end part 3 brings about a compression of the membrane means I 1. When the plunger 5 moves in the cylindrical space 5 inwards into the end part 3, the membrane means 11 returns to its original form.

Figure 6:
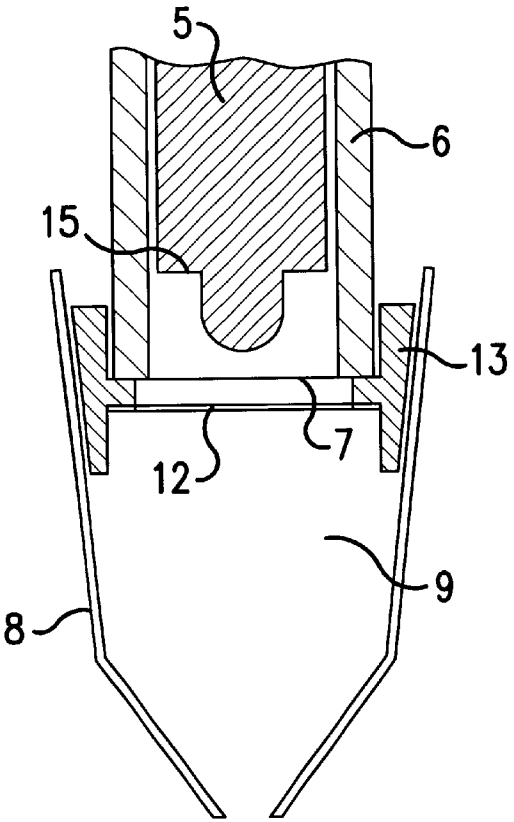

In FIG. 6 an alternative preferred embodiment of the invention is shown. The membrane frame 13 of the membrane means is mounted removably onto the distal end 6 of the end part of the suction device e.g. with a friction joint. The tip 8 is attached on the distal end 6 of the end part of the suction device so that the inner surface of the sample space 9 of the tip attaches in a gas-tight manner against the outer suface of the mebrane frame 13.

Figure 7:
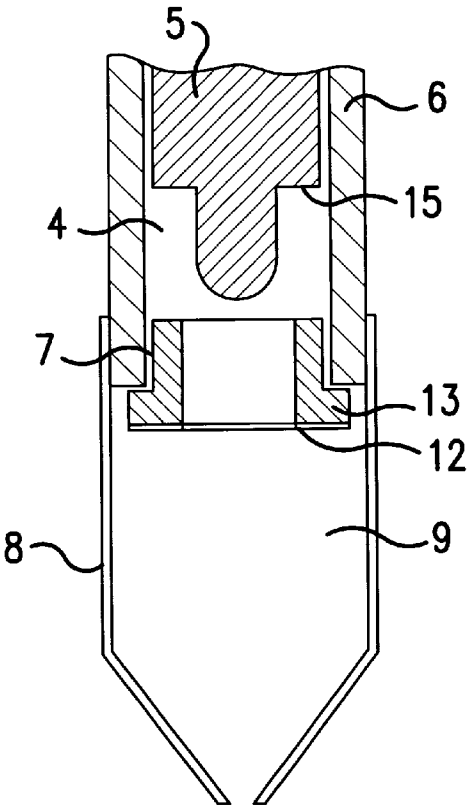

In FIG. 7 another embodiment of the invention is shown. The membrane means is inserted to the opening 7 in the distal end 6 of the end part of the suction device and attaches into the opening 7 e.g. with a friction joint. The tip 8 is mounted removably on the distal end 6 of the end part or the suction device in a known way. The membrane means can be released from the opening by moving the plunger 5 towards the opening 7 so that the shoulder 15 in the plunger 5 comes in contact with that part of the membrane frame, which extends into the cylindrical space 4, and the continuating movement of the plunger 5 disengages the membrane means from the opening 7.

Figure 8:
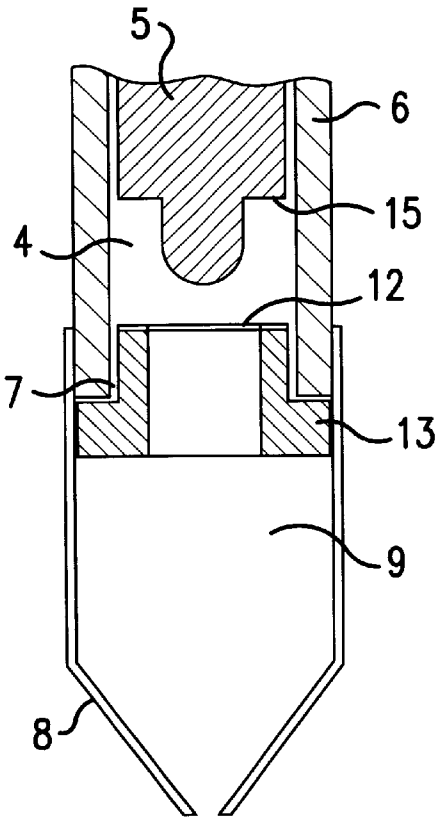
FIGS. 6–8 are different embodiments of the invention.

In FIG. 8 the membrane means is mounted in the opening 7 in the distal end 6 of the end part of the suction device e.g. with a friction joint. The tip 8 is attached onto the distal end 6 of the end part of the suction device so that the innner surface of the tip 8 is in a gas-tight connection with the outer surface of the member means extending out of the opening 7 into the sample space 9 of the tip 8. In a preferred embodiment of the invention, the membrane means and the tip 8 can be removed together from the suction device with the plunger 5 by moving the plunger 5 towards the opening 7 so that the shoulder 15 in the plunger 5 comes into contact with that part of the membrane means which extends into the cylidrical space 4. By continuing the movement of the plunger 5, the membrane means and the tip 8 mounted thereon are released from the suction device.

In the advantageous embodiments according to the invention, shown in the figures, the membrane means 11 can be removed from the pipette in a very simple way, without touching it by hand. One alternative for carrying this out is disclosed in FIG. 4 where at the end of the plunger 5, or in the vicinity thereof, there is a shoulder 15, which as a result of the continuing movement of the plunger comes into contact with removal means 14 in the membrane means 11, and brings about the removal of the membrane means from the end part of the suction device. Another alternative embodiment is an extension part, associated with the plunger 5, which part is telescopically movable in relation to the plunger 5 in its length-wise direction towards the distal end 6 of the end part 3 of the suction device 1 and away therefrom. In order to remove the membrane means 11, the extension part is made to move towards the distal end 6 of the end part 3 by means of appropriate manually operated means from the body 2 of the suction device 1, whereby the extension part pushes the membrane means loose from the end part 3.

Still in another preferred embodiment, in which the membrane means 11 is in seating contact with the inner surface of the sample space 9 of the tip 8, the movement of the plunger 5 outwards of the end part 3 causes the membrane means 11, or projections, pegs, or other similar means associated therewith and projecting from the membrane means into the sample space 9 of the tip 8, to come into contact with the inside surface of the tip 8, or into contact with projections, pegs, fins, or other similar means 17 projecting into the sample space 9 from the inside surface of the tip, the continuation of the movement of the plunger bringing about the removal of the tip 8 from the distal end 6 of the end part 3 of the suction device 1 together with the removal of the membrane means 11.

What is claimed:

1. A suction device for dispensing a liquid comprising a body and an associated end part, the end part having a first end and an opposite end with a cylindrical bore therebetween, the opposite end being a distal end directed away from the body and the first end being associated with the body, the suction device further comprises a reciprocable plunger in the bore and a tip enclosing a sample space, the tip being readily attachable to and detachable from the opposite end of the end part, the distal end of the end part with an attached tip being closed from the sample space with a liquid and gas impermeable, flexible, reversibly deformable membrane means, the membrane means being within reach of the plunger which can contact and deform the membrane means resulting in a change in volume of the sample space.

2. The suction device according to claim 1, wherein the membrane means is mounted into the cylindrical space.

3. The suction device according to claim 2, wherein the membrane means, removably mounted in the cylindrical space, is a bellows, reversibly compressible bag, open towards the tip, an open mouth part of which attaches, forming a gas-tight seal, to the distal end of the end part and a closed part of which, located in the cylindrical space, is contactable with the plunger movable in the cylindrical space for compressing the membrane means with movement of the plunger.

4. The suction device according to claim 1, wherein the membrane means is mounted at the distal end of the end part of the suction device to close the end part.

5. The suction device according to claim 1, wherein the membrane means extends into the sample space of the tip attached onto the distal end of the end part of the suction device.

6. The suction device according to claim 1, wherein the membrane means comprises a membrane, which is mounted on a frame.

7. The suction device according to claim 6, wherein the frame is mounted in the bore of the end part.

8. The suction device according to claim 6, wherein the frame is mounted at the distal end of the end part of the suction device to close the bore.

9. The suction device according to claim 6, wherein the frame is adapted to be supported in the bore in the distal end of the end part, against a shoulder formed in an inner surface thereof, and the membrane is mounted on the part of the frame away from the end part.

10. The suction device according to claim 9, wherein the frame extends out of the opening into the sample space of the tip and is provided on its outer surface with means for providing a gas-tight seal between the frame and an inner surface of the sample space of the tip attachable onto the distal end of the end part.

11. The suction device according to claim 6, wherein the frame is adapted to be supported in the opening in the distal end of the end part, and the membrane is mounted on the part of the frame inside the opening.

12. The suction device according to claim 1, wherein the plunger is movable through the bore of the end part.

13. The suction device according to claim 1, wherein the plunger, reciprocatingly movable in the bore within the end part of the suction device, is provided with means for removing the membrane means from the end part.

14. The suction device according to claim 13, wherein the means for removing the membrane means comprises shoulders, projections, pegs, or fins projecting from the plunger, which come into contact with the membrane means, when the plunger moves to a removal position.

15. The suction device according to claim 14, wherein the shoulders, projections, pegs, or fins on the plunger are engageable with the membrane frame.

16. The suction device according to claim 13, wherein the plunger, reciprocatingly movable in the bore within the end part of the suction device, is provided with a telescopic extension for removing the membrane means.

17. The suction device according to claim 1, wherein the membrane means has a membrane mounted on a frame provided with means for attachment to the distal end.

18. The suction device according to claim 17, wherein the frame includes elements and the plunger includes complementing elements for loosening the attachment with continued movement of the plunger towards the distal end.

19. The suction device according to claim 1, wherein the tip includes elements coacting with the frame for simultaneous removal of the tip from the distal end.

* * * * *